US005857446A

United States Patent [19]

Norton

[11] Patent Number: 5,857,446

[45] Date of Patent: Jan. 12, 1999

[54] FUEL VAPOR SOURCE

[76] Inventor: Peter Norton, P.O. Box 62, Northville, Mich. 48167

[21] Appl. No.: 714,197

[22] Filed: Sep. 16, 1996

Related U.S. Application Data

[63] Continuation-in-part of Ser. No. 674,175, Jul. 1, 1996.

[51] Int. Cl.[6] ..... F02M 37/04

[52] U.S. Cl. ..... 123/520; 123/516

[58] Field of Search ..... 123/520, 521, 123/518, 519, 516

[56] References Cited

U.S. PATENT DOCUMENTS

| | | | |
|---|---|---|---|
| 5,245,975 | 9/1993 | Ito | 123/520 |
| 5,511,529 | 4/1996 | Blumenstock | 123/520 |
| 5,533,479 | 7/1996 | Wild | 123/520 |
| 5,609,141 | 3/1997 | Matsuoka | 123/520 |
| 5,630,403 | 5/1997 | Van Kampen | 123/520 |
| 5,653,211 | 8/1997 | Ishikawa | 123/520 |
| 5,680,756 | 10/1997 | Harima | 123/520 |
| 5,696,317 | 12/1997 | Rychlick | 123/520 |

*Primary Examiner*—Carl S. Miller

*Attorney, Agent, or Firm*—Reising, Ethington, Learman & McCulloch, PLLC

[57] ABSTRACT

A canister contains two cartridges of activated carbon for storing fuel in gasoline powered motor vehicles. A first cartridge operates to prevent release of hydrocarbons vaporized in the fuel tank while the vehicle is not operating. The second cartridge performs two functions. First, the second cartridge traps fuel in vapor displaced during refueling. Second, the second cartridge is charged with adsorbed fuel after the engine is stopped. Vaporous fuel from the first and second cartridges is supplied to fuel the engine upon startup. An air-fuel ratio sensor and a fuel vapor sensor are achieved by comparing the transit time of sound in two chambers, one containing air and the other containing a mixture of air and fuel. After the engine is stopped a solenoid valve is closed and an electrically energized air pump draws vapor from the fuel tank through the second cartridge to charge it with fuel. Charging is terminated when the fuel vapor sensor senses that fuel has passed through the second cartridge without being adsorbed. The air-fuel ratio sensor measures the ratio of air to fuel provided to the engine during initial startup for controlling a valve to maintain a desired air-fuel ratio. A vacuum actuated spool valve reconnects one sensor enabling it to perform both the vapor sensing function and air-fuel ratio sensing function as required.

24 Claims, 5 Drawing Sheets

FUEL VAPOR SOURCE

This application is a continuation-in-part of application Ser. No. 08/674,175 filed Jul. 1, 1996 and titled Fuel Vapor Source.

FIELD OF THE INVENTION

This invention relates to means for providing gaseous fuel for enhancing performance and reducing unwanted emissions during startup of gasoline powered engines. Secondly, it relates to means for preventing hydrocarbon release while the fuel tank of a vehicle is being filled. Finally, it relates to means for preventing hydrocarbon release to the atmosphere while a vehicle is not operating.

BACKGROUND OF THE INVENTION

Gasoline engines emit undesirable amounts of hydrocarbons when first started. This happens because liquid gasoline can become trapped in crevices in a cold engine and not be vaporized in time to participate in combustion and because the catalytic converter does not oxidize hydrocarbons until it reaches a "light-off" temperature. This problem is exacerbated by the need to provide a fuel rich mixture when the engine is first started. One known way to reduce hydrocarbon emissions is to electrically heat part of the catalytic converter before starting the engine. This has the disadvantages of delaying starting and requiring large amounts of electrical energy at times when the battery is least able to supply such energy. Another known way to reduce hydrocarbon emissions at startup is to pass the exhaust through an adsorbent for trapping hydrocarbons. When the catalytic converter reaches operating temperature the adsorbent is flushed and the catalytic converter oxidizes the flushed hydrocarbons.

Canisters of activated carbon have been used for many years to adsorb fuel vaporized while vehicles are not operating. The canisters are purged while the vehicle is operating thereby preparing them to adsorb fuel again. A number of types of activated carbon are in current use or available made from raw materials such as wood and coal.

Vapor in a fuel tank may contain one to three grams of fuel per liter of vapor which is displaced during refueling and may escape into the atmosphere. It is well known that filling a vehicle fuel tank at normal flow rates produces sufficient pressure in the filler tube to cause vapor to pass through a canister of activated carbon where it can be adsorbed to prevent hydrocarbons from entering the atmosphere. This does not happen in current production vehicles because a bypass is provided at the filler tube and canister size is inadequate.

It is also well known that during purging activated carbon releases the most volatile species before releasing less volatile species. Activated carbon charged with vapors from gasoline first releases predominantly butanes, then releases predominantly pentanes.

Oxygen sensors in the exhaust of gasoline engines have been standard equipment for many years. After a brief warmup period they indicate the presence of oxygen in the engine exhaust whereupon the information provided is used to optimize the delivery of fuel to the engine.

The velocity of sound in air is about 330 meters per second and the velocity of sound in butanes is about 215 meters per second. In a mixture the velocity varies between these values. In a stoichiometric mixture of air and butane the velocity of sound is about 9 meters per second slower than in pure air.

A general object of this invention is to provide a means for reducing hydrocarbon emissions and improving operation of gasoline powered engines during initial startup which also overcomes certain disadvantages of the prior art.

SUMMARY OF THE INVENTION

The present invention provides a canister containing two separated cartridges of activated carbon. The first cartridge traps fuels in vapor vented when the vehicle is not operating and pressure in the fuel tank rises above atmospheric. The second cartridge has two functions. First, it traps fuel in vapor displaced while the fuel tank is filled. Second, it is charged with fuel after the engine is stopped. The fuel adsorbed by both cartridges is released to fuel the engine during startup. This is advantageous because vaporous fuel burns more completely than liquid fuel thereby reducing hydrocarbon emissions and improving engine operation.

Further, in accordance with the invention, the second cartridge stores sufficient fuel that only the first species deadsorbed (predominantly butanes in most cases) issues before the oxygen sensor is operational. Thereby, before the oxygen sensor becomes operational, the velocity of sound in the air-fuel mixture is a known function of the air to fuel ratio which advantageously enables measurement of the air to fuel ratio by measuring the velocity of sound in the mixture.

Further, in accordance with the invention, an acoustic transducer generates an outgoing acoustic signal and also receives an echo of that signal which is advantageous because the effects of movement of the medium in which the signal moves are substantially cancelled during the opposite directions of sound travel.

Further, in accordance with the invention, an acoustic transducer generates a radial outgoing acoustic signal and a cylindrical reflector concentric with the outgoing acoustic signal reflects the signal back toward the transducer thereby advantageously concentrating the reflected sound on the transducer and increasing the received acoustic signal.

Further, in accordance with the invention, an air-fuel ratio sensor comprises means responsive to the velocity of sound in the mixture of air and fuel.

Further, in accordance with the invention, an air-fuel ratio sensor comprises means for comparing the transit time of sound in the mixture of air and fuel with the transit time of sound in air not mixed with fuel.

Further, in accordance with the invention, a desired air-fuel ratio is maintained by controlling a valve in response to an air-fuel ratio sensor.

Further, in accordance with the invention, a fuel vapor sensor comprises means for comparing the transit time of sound in air which might contain fuel with the transit time of sound in air not mixed with fuel.

Further, in accordance with the invention, a single sensor is provided and valve means operated by intake manifold vacuum reconnects the single sensor to serve as both the air-fuel ratio sensor and as the fuel vapor sensor.

Further, in accordance with the invention, charging of the aforementioned second cartridge is accomplished by closing a solenoid valve and using an electric pump to draw vapor from the fuel tank through the aforementioned second cartridge.

Further, in accordance with the invention, fuel vapor from the canister may be augmented at certain times by liquid fuel.

A complete understanding of this invention may be obtained from the description that follows taken with the accompanying drawings.

BEST MODE FOR CARRYING OUT THE INVENTION

Figure 1:
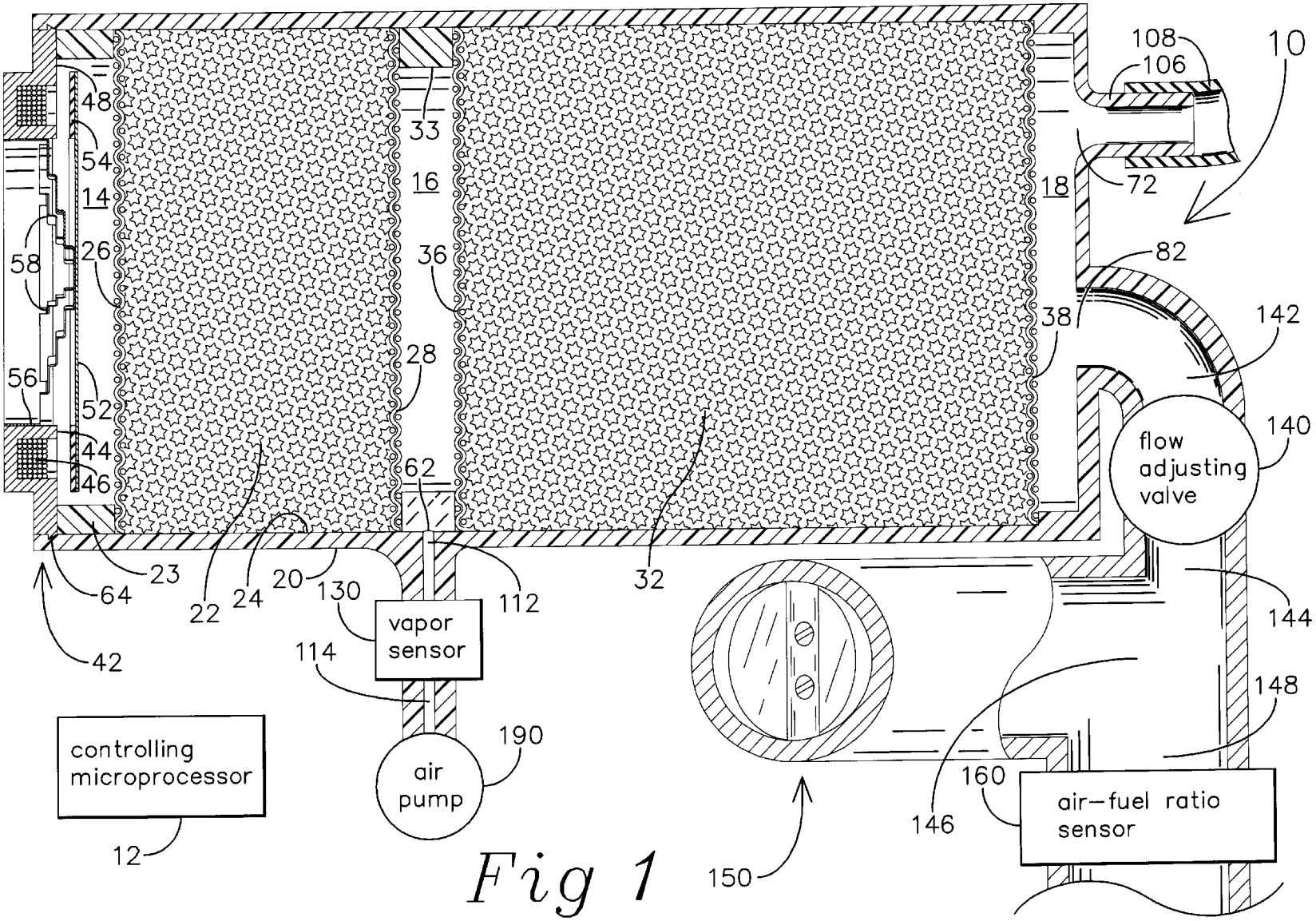
FIG. 1 shows a side view of the canister of the invention with certain parts shown in section.
Figure 2:
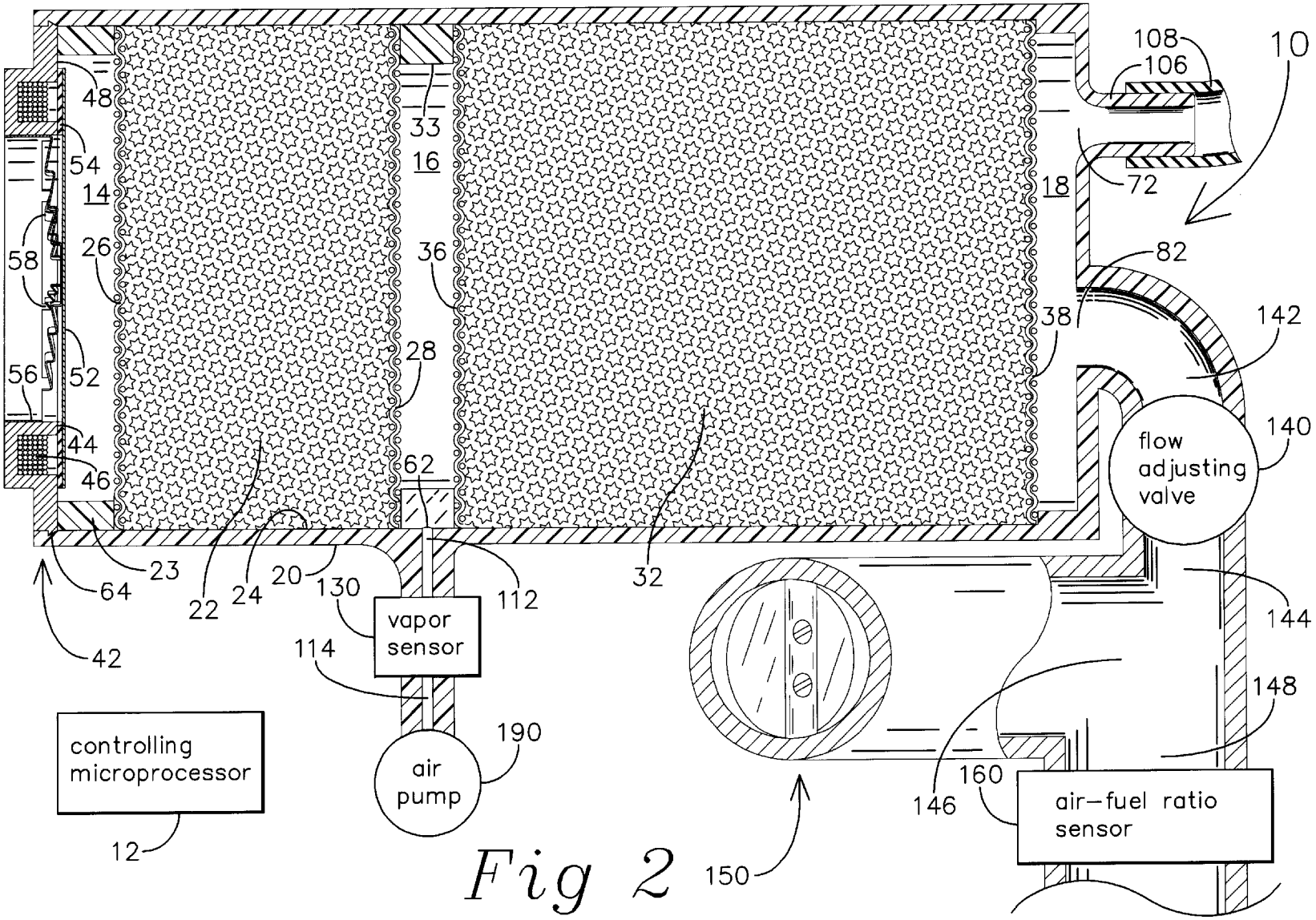
FIG. 2 shows the side view of the canister of the invention illustrated in FIG. 1 with the solenoid valve closed.

Referring now to FIGS. 1 and 2, the fuel vapor source 10 contains activated carbon cartridges 22 and 32. During operation of the fuel vapor source 10 the cartridges 22 and 32 of the fuel vapor source 10 adsorb and release fuel vapors thereby preventing release of hydrocarbons to the atmosphere during vehicle refueling, temperature changes while the vehicle is not operating, and during operation immediately after the engine is started. It will be appreciated as the description proceeds that the invention may be implemented in different embodiments.

Controlling microprocessor 12 controls operation of the fuel vapor source 10. Preferably, controlling microprocessor 12 is the microprocessor that controls other aspects of engine operation. Controlling microprocessor 12 is connected to the fuel vapor sensor 130 for receiving indication of fuel in vapor entering through passage 112 and to air-fuel ratio sensor 160 for receiving indication of the ratio of air to fuel entering sensor 160 through passage 148. Controlling microprocessor 12 is also connected to solenoid valve 42 for energizing it to close and to electric air pump 190 for energizing it to operate. FIG. 2 is the same as FIG. 1 except that it illustrates solenoid valve 42 closed to enable air pump 190 to draw vapor from the fuel tank. Controlling microprocessor 12 is also connected to flow adjusting valve 140 for energizing it to change its state to be more open or less open.

Outer housing 20 contains activated carbon cartridges 22 and 32 separated by spacer 33. Normally open solenoid valve 42 is located at one end of outer housing 20 adjacent spacer 23 thereby completing the outer enclosure. Openings 62, 72 and 82 in outer housing 20 communicate respectively with fuel vapor sensor 130, the vehicle fuel tank (not illustrated), and chamber 146 of the intake manifold. Opening 62 communicate with air pump 190, through passage 112, fuel vapor sensor 130, and passage 114. Opening 72 communicates with the vehicle fuel tank (not illustrated) through nipple 106 and elastomeric tubing 108. Opening 82 communicates with chamber 146 of the engine intake manifold through passage 142, flow adjusting valve 140, and passage 144. Throttle 150 is controlled by the vehicle operator to supply air to chamber 146 of the vehicle intake manifold.

Outer housing 20 is preferably molded from a suitable moldable plastic. Any of the plastics presently being used for the housings of carbon canisters for vehicles are examples of suitable moldable plastics.

Cartridge 22 is an aggregate of activated carbon granules retained by the inside diameter 24 of outer container 20 and screens 26 and 28. Similarly, cartridge 32 is an aggregate of activated carbon granules retained by the inside diameter 24 of outer container 20 and screens 36 and 38. Screens 26, 28, 36 and 38 retain the activated carbon granules but allow vapor to pass.

Cartridges 22 and 32 are preferably made of any of the activated carbon granules used in current production vehicles. Other available forms of activated carbon may be substituted by those skilled in the art to achieve possibly desired results such as different resistance to flow or greater capacity.

Normally open solenoid valve 42 comprises valve seat 44, solenoid coil 46 in electromagnet stator 48, valve plate 52, resilient seal 54 and valve plate support 56 with resilient legs 58 which hold valve plate 52 in its normally open position. The assembled solenoid valve 42 is retained by annular latch 64.

Electromagnet stator 48 and valve plate 52 are preferably made of a high permeability material such as low carbon steel coated to prevent rust. Resilient seal 54 is made of any of the known elastomeric sealing materials such as silicone rubber or neoprene rubber in formulations known by those skilled in the art of formulating rubberlike materials to maintain their resiliency for the expected lifetime of the automobile in the atmosphere encountered in the part of the automobile where the fuel vapor source 10 is to be located. Valve plate support 56 is preferably made of an inexpensive and durable spring material such as spring steel and is preferably attached by welding. riveting or adhesive to valve plate 52.

Electric air pump 190 may be of any design capable of drawing vapor from the vehicle fuel tank and through cartridge 32 at a rate of about 5.0 liters per minute. The required pressure is a small fraction of an atmosphere which can be provided by a pump of the piston type or a pump of the centrifugal impeller type. Particularly preferred pumps are diaphragm pumps or solenoid driven piston pumps which offer low cost and are easily controlled to operate at different flow rates.

Fuel vapor sensor 130 senses the presence of fuel in the vapor received through passage 112. A preferred embodiment of fuel vapor sensor 130 will be described hereinafter with reference to FIGS. 3 through 6.

Flow adjusting valve 140 controls the flow of vapor from cartridges 22 and 32 of fuel vapor source 10. When flow adjusting valve 140 is open and there is sufficient vacuum at chamber 146 of the intake manifold, air is drawn through solenoid valve 42, cartridge 22, cartridge 32, passage 142, flow adjusting valve 140, and passage 144 to chamber 146 of the engine intake manifold. Flow adjusting valve 140 is a motorized valve designed to accurately control gas flow through itself. Flow adjusting valve 140 is preferably operated by a motor of the type that remains in a position once placed there. One suitable motor is a stepping motor that remains where it is set by virtue of the detent like effect of permanent magnets. Another suitable design is a motor of the type operated by a magnetically powered pawl engaging a ratchet. Either motor design advantageously requires electrical energy only when changing position. Other motor types may be selected by those skilled in the art of motorized valve design. Also, flow adjusting valve 140 must be designed to close tightly to prevent leakage when it is closed.

Air-fuel ratio sensor 160 senses the ratio of air to fuel in the gas exiting chamber 146 of the engine intake manifold through passage 148 at times when flow adjusting valve 140 is open.

Preferred embodiments of fuel vapor sensor 130 and air-fuel ratio sensor 160 will now be described with reference to FIGS. 3 through 6. In FIGS. 3 through 6 sensor 210 performs, depending on the state of spool valve 172, the functions of either fuel vapor sensor 130 or air-fuel ratio sensor 160. When spool 174 of spool valve 172 is in its first position illustrated in FIG. 3 sensor 210 performs the function of fuel vapor sensor 130. When spool 174 of spool valve 172 is in its second position illustrated in FIG. 5 sensor 210 performs the function of air-fuel ratio sensor 160.

Air pump 190 has two functions. When spool 174 of spool valve 172 is in its first position illustrated in FIG. 3 air pump 190 is connected to draw air through passage 112 for charging cartridge 32 with fuel. When spool 174 of spool valve 172 is in its second position illustrated in FIG. 5 air pump 190 is connected to draw air-fuel mixture from passage 148 of the intake manifold through sensor 210 for measuring the ratio of air to fuel.

Spool valve 172 comprises a three flanged spool 174 sealingly movable in cavity 176. Spring 178 maintains spool 174 in the position illustrated in FIG. 3 at times when there is no vacuum in chamber 146 of the engine intake manifold. When there is sufficient vacuum in chamber 146 differential pressure across piston 182 of spool 174 urges piston 182 to compress spring 178 and move spool 174 to the position illustrated in FIG. 5. Spool 174 comprises flanges 184, 186, and 188 which in combination with the walls of cavity 176 form chambers 192, 194 and 196.

Figures 3, 4:
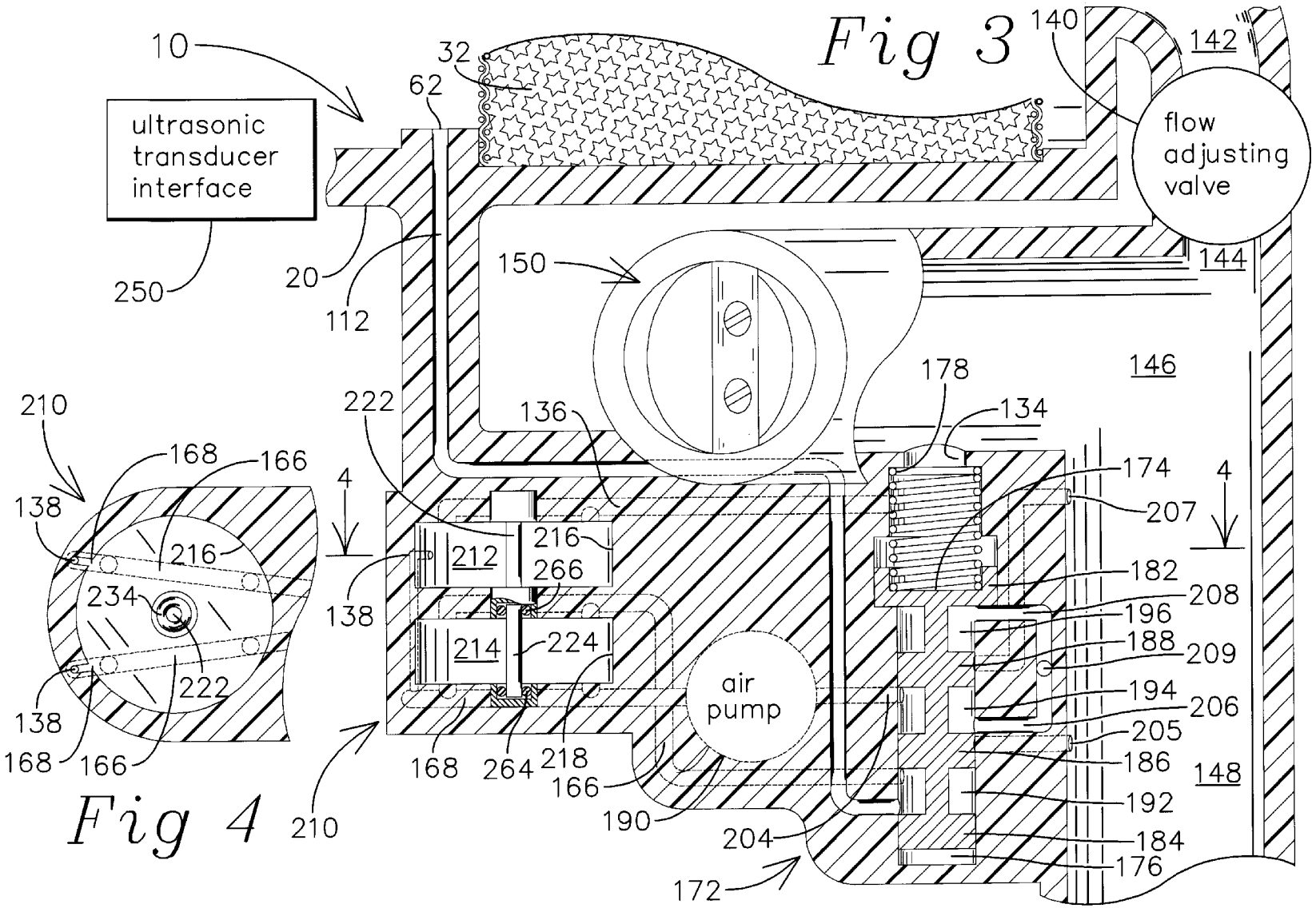
FIG. 3 shows, partly schematically, a view of the fuel vapor sensor and the air-fuel ratio sensor of the invention with certain parts shown in section.
FIG. 4 shows a view of the fuel vapor sensor and the air-fuel ratio sensor of the invention taken at section 4—4 of FIG. 3.

Continuing with reference to FIGS. 3 and 4 in which spool 174 of spool valve 172 is in its first position, fuel vapor sensor 130 (illustrated in FIGS. 1 and 2) comprises an air fuel mixture circuit and a comparison air circuit. The air fuel mixture circuit comprises opening 62 from the interior of outer housing 20, passage 112, chamber 192 of spool valve 172, passages 166 of sensor 210, chamber 214 of sensor 210, passages 168 of sensor 210, air pump 190, passage 204 between air pump 190 and chamber 194 of spool valve 172 and passages 206 and 209 to the atmosphere. The comparison air circuit provides air free of fuel for comparing with the air containing fuel. The comparison air circuit comprises passage 134 which connects with the engine intake manifold, passages 136, chamber 212 of sensor 210 and passages 138 which join passages 168 of the fuel vapor sensing circuit described immediately above to connect through air pump 190 and spool valve 172 to the outside atmosphere. The size of passages 138 or other means such as an orifice (not illustrated) limits flow through the comparison circuit to a fraction of the flow through the air fuel mixture circuit.

Figure 5:
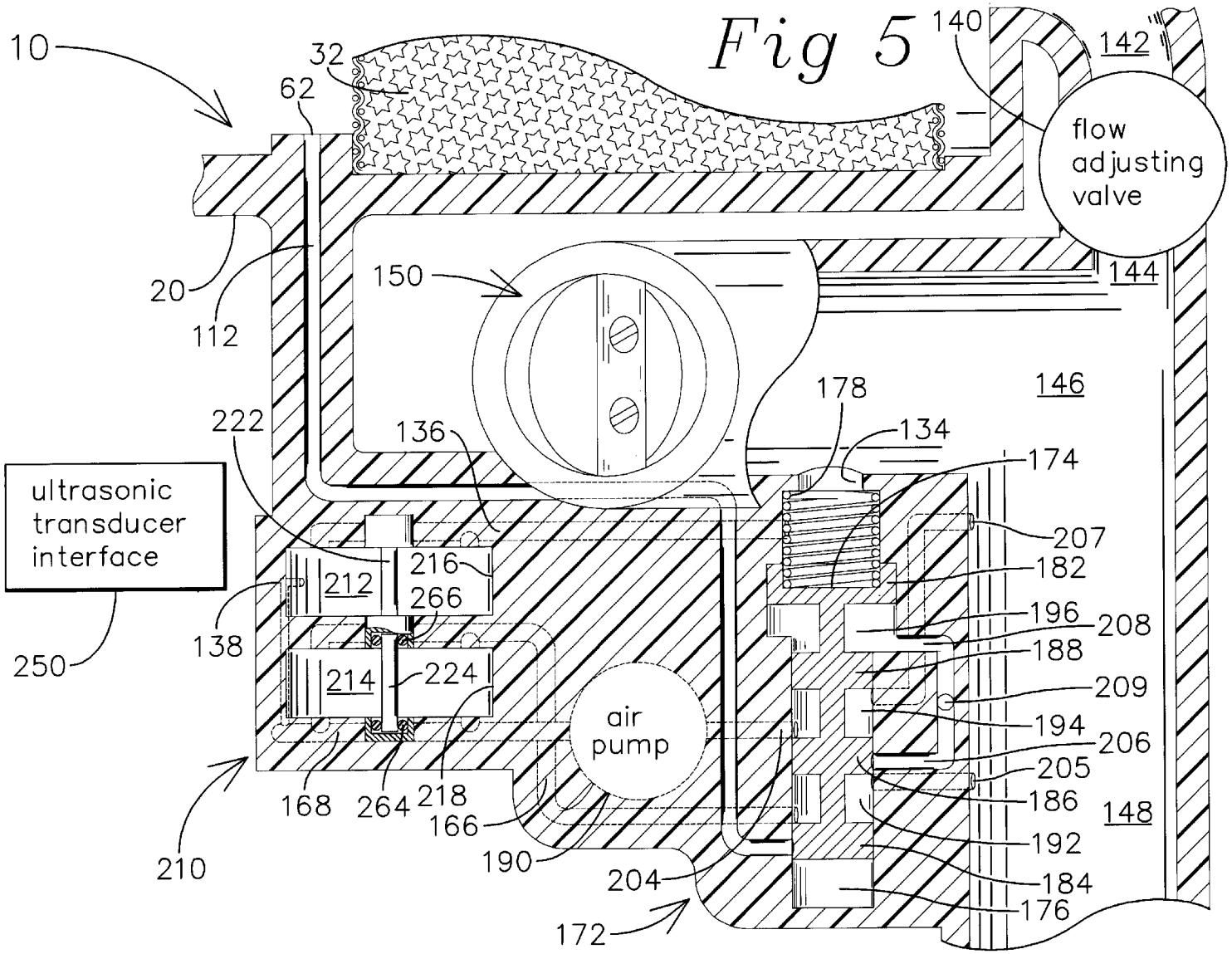
FIG. 5 shows the view of the fuel vapor sensor and the air-fuel ratio sensor of the invention illustrated in FIG. 3 with the spool valve in an alternate position.

Sensor 210 comprises chambers 212 and 214 having cylindrical walls 216 and 218 respectively and ultrasonic transducers 222 and 224 concentric respectively with walls 216 and 218 and connected with ultrasonic transducer interface 250. Ultrasonic transducers 222 and 224 are preferably tubular cylindrical piezoelectric transducers adapted to generate and respond to sound propagating perpendicular to their axes of rotational symmetry. Other available transducer designs may be used. Another preferred transducer design comprises a flat plate oriented perpendicular to the axis of a tube in which it may be placed at the center or one end with reflectors respectively at both ends or one end of the tube. Ultrasonic transducer 222 is resiliently supported by O-rings 234 and 236. (O-ring 234 is illustrated in FIG. 4, O-ring 236 is not illustrated.). O-rings 264 and 266 illustrated in FIGS. 3 and 5 are the same except for location as O-rings 234 and 236. O-rings 234 and 236 insulate transducer 222 from acoustic vibrations conducted through the material surrounding chamber 212. Ultrasonic transducer 224 is resiliently supported by O-rings 264 and 266. O-rings 264 and 266 insulate transducer 224 from acoustic vibrations conducted through the material surrounding chamber 214.

Continuing now with reference to FIGS. 4 and 5 in which spool valve 172 is in its second position, air-fuel ratio sensor 160 (illustrated in FIGS. 1 and 2) comprises an air fuel mixture circuit and a comparison air circuit. The air fuel mixture circuit comprises passage 205 from the intake manifold, chamber 192 of spool valve 172, passages 166 of sensor 210, chamber 214 of sensor 210, passages 168 of sensor 210, air pump 190, passage 204, chamber 194 of spool valve 172 and passage 207 to the engine intake manifold. The comparison air circuit provides pure air for comparing with the air containing fuel. The comparison air circuit comprises passage 134 which connects with the engine intake manifold upstream from chamber 146 where the incoming air from throttle 150 has not yet mixed with fuel vapor, passages 136, chamber 212 of sensor 210 and passages 138 which join passages 168 of the air fuel mixture circuit described immediately above to connect through air pump 190 and spool valve 172 to the engine intake manifold.

Figure 6:
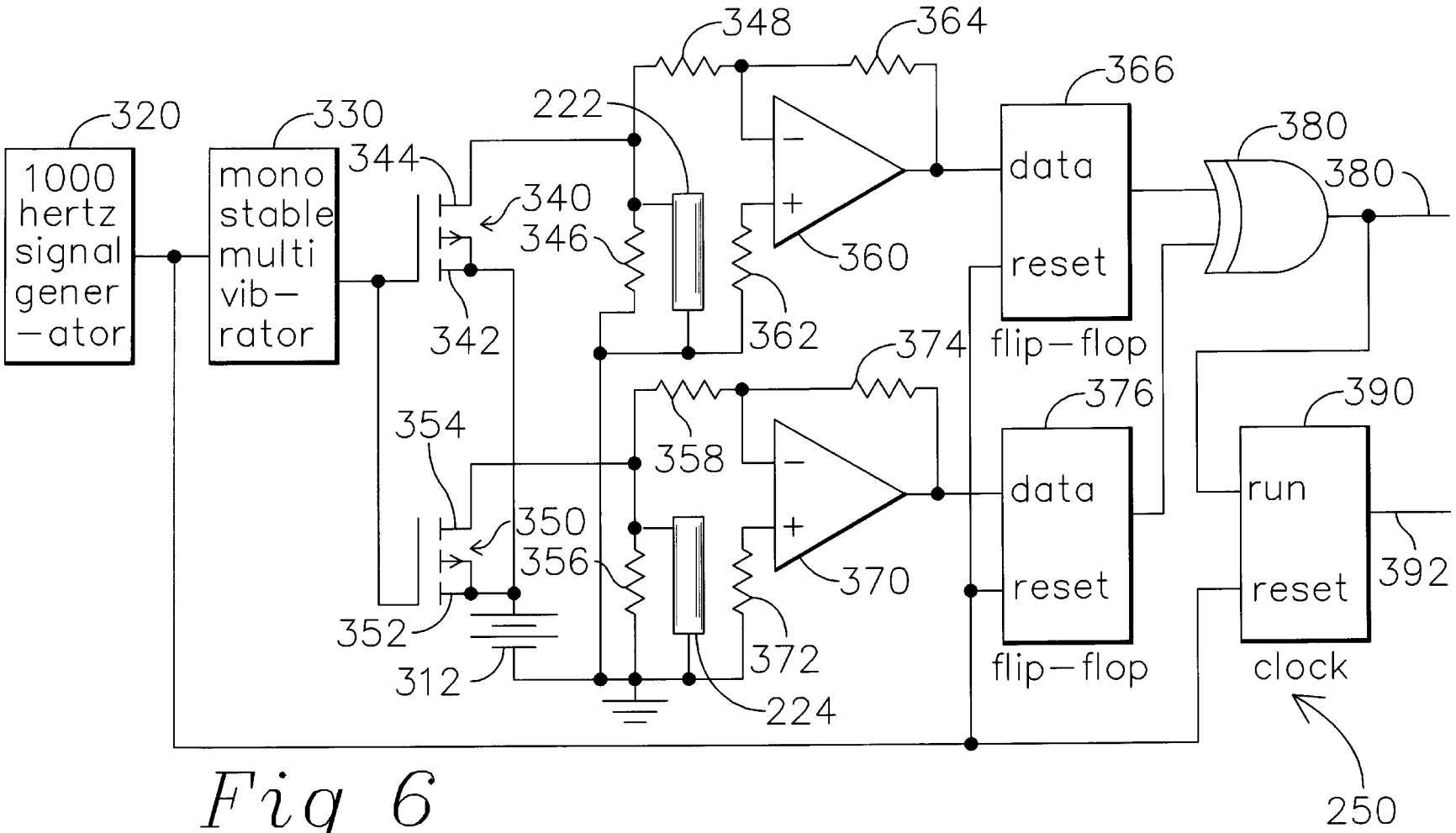
FIG. 6 shows the ultrasonic transducer interface schematically.

Referring now to FIG. 6, the ultrasonic transducer interface 250 in combination with ultrasonic transducers 222 and 224 generate acoustic signals and receive echoes of the acoustic signals to determine the presence of fuel or the ratio of air to fuel in sensor 210.

Continuing with reference to FIG. 6, ultrasonic transducer interface 250 comprises signal generator 320, monostable multivibrator 330, p-channel mosfet power transistors 340 and 350, operational amplifiers 360 and 370, D-type flip flops 366 and 376, exclusive OR 380, and clock or ramp generator 390. It also includes resistors 346, 348, 356, 358, 362, 364, 372 and 374. Piezoelectric transducers 222 and 224 are included schematically in FIG. 6 with their connections illustrated. Battery 312 indicates schematically a source of voltage for momentary application to piezoelectric transducers 222 and 224 to generate acoustic signals.

Signal generator 320 is adapted to generate a square wave output at a frequency such as one thousand square waves per second. The logic high to logic low transition of the output of signal generator 320 causes ultrasonic transducers 222 and 224 to generate acoustic signals. The logic low to logic high transition of the output of signal generator 320 resets D-type flip-flops 366 and 376 and resets clock or ramp generator 390 to zero output in preparation for receipt of signals from transducers 222 and 224. The logic low to logic high transition of the output of signal generator 320 must precede receipt of the first echo signal but preferably does not precede it by any greater time than necessary to minimize the likelihood that noise will be mistaken for receipt of the echo.

Monostable multivibrator 330 has a logic high output signal at all times except after transition of the output of signal generator 320 from logic high to logic low when the output of monostable multivibrator 330 goes to logic low and remains there for a brief time such as two microseconds. P-channel mosfet transistors 340 and 350 are electrically conductive when the output of monostable multivibrator 330 is at logic low and are electrically insulating when the output of monostable multivibrator 330 is at logic high. Therefore, when the output of monostable multivibrator 330 is at logic low, P-channel mosfet transistor 340 applies a voltage from voltage source 312 to the outer electrode of piezoelectric transducer 222 for the aforementioned brief time such as two microseconds and P-channel mosfet transistor 350 applies a voltage from voltage source 312 to the outer electrode of piezoelectric transducer 224 for the aforementioned brief time such as two microseconds. Resistors 346 and 356 discharge piezoelectric transducers 222 and 224 respectively after the output of monostable multivibrator 330 returns to logic high and mosfet transistors 340 and 350 no longer apply voltages to the ultrasonic transducers 222 and 224.

Amplifier 360 amplifies the signal received from piezoelectric transducer 222. The output of amplifier 360 is applied to the data input of D-type flip flop 366 to cause it to change from its reset state wherein its output is at logic low to its set state wherein its output is at logic high. D-type flip flop 366 also has a reset input that is connected with the output of signal generator 320. When the signal at its reset input goes from logic low to logic high the output of D-type flip flop 376 is reset to logic low.

Amplifier 370 amplifies the signal received from piezoelectric transducer 224. The output of amplifier 370 is applied to the data input of D-type flip flop 376 to cause it to change from its reset state wherein its output is at logic low to its set state wherein its output is at logic high. D-type flip flop 376 also has a reset input that is connected with the output of signal generator 320. When the signal at its reset input goes from logic low to logic high the output of D-type flip flop 376 is reset to logic low.

Exclusive OR 380 provides a logic high output when one of its inputs is high and a logic low output when its inputs are both high or both low. Clock 390 provides at its output 292 a signal indicating the amount of time since the last reset pulse that the output of exclusive OR 380 has been in its logic high state. This is a measure of the fraction of fuel in the gases in sensor 210.

Clock 390 may be either a digital scaler that counts continuously while its run input is at logic high or a ramp generator that produces a voltage that rises at a constant rate while its run input is at logic high and remains constant while its run input is at logic low. When the signal at its reset input goes from logic low to logic high clock 390 resets its output to zero.

The outputs of exclusive OR 380 and clock 390 are provided to controlling microprocessor 12. When the output of exclusive OR 380 is at logic low and the output of clock 390 is not zero the output of clock 390 indicates the fraction of fuel in chamber 214 of sensor 210.

The operation of the fuel vapor source 10 of the invention will now be described with reference to FIGS. 1 and 2. There are three modes of operation described hereinafter. 1) Charging cartridge 32 of fuel vapor source 10 when it is discharged; 2) Trapping vapors from the vehicle fuel tank during fuel tank refueling or during a day night cycle; and 3) supplying fuel vapor from cartridges 22 and 32 to fuel the vehicle engine during initial startup.

First mode of operation—charging cartridge 32.

Initially, fuel vapor source 10 is discharged, that is no fuel is stored in cartridges 22 and 32. This state may occur when the fuel vapor source 10 is new or as a result of purging during the third mode of operation. Before fuel vapor source 10 can supply fuel to an automobile engine at startup, cartridge 32 must be charged.

After the engine is stopped controlling microprocessor 12 operates to charge cartridge 32 of fuel vapor source 10. To do this electric air pump 190 and solenoid valve 42 are energized by controlling microprocessor 12 and flow adjusting valve 140 is controlled to be in its closed state by controlling microprocessor 12. FIG. 2 illustrates solenoid valve 42 in its closed state. Solenoid valve 42 is closed because controlling microprocessor 12 has energized coil 46 of solenoid valve 42. The vacuum from air pump 190 causes vapor to be drawn from the vehicle fuel tank (not illustrated) through tube 108 and nipple 106, past screen 38, through cartridge 32 of activated carbon where fuel is adsorbed leaving the air to continue past screen 36, through passage 112, fuel vapor sensor 130 and passage 114 to air pump 190.

When the activated carbon in cartridge 32 becomes saturated with fuel it allows fuel to exit through passage 112 to fuel vapor sensor 130. When this happens sensor 130 indicates to controlling microprocessor 12 that it is sensing fuel whereupon controlling microprocessor 12 deenergizes solenoid valve 42 which causes it to open and deenergizes electric air pump 190 which causes it to stop pumping air. At this time fuel vapor source 10 is charged and capable of supplying fuel vapor through passage 142 and flow adjusting valve 140 to the vehicle engine.

Second mode of operation—preventing fuel release into the atmosphere during vehicle fueling or temperature cycles When the vehicle is not operating and at certain times during operation pressure in the fuel tank can exceed the pressure in the atmosphere outside the fuel tank. This can be the result of vaporization of fuel in the fuel tank because of a temperature increase or addition of fuel to the fuel tank during refueling. When pressure in the fuel tank exceeds atmospheric pressure the pressure is relieved by conveying the vapor from the fuel tank (not illustrated) through tube 108 to nipple 106 of vapor source 10, past screen 38, through cartridge 32, past screens 36 and 28, through cartridge 22, past screen 26 and solenoid valve 42 into the atmosphere. Unless cartridge 32 is saturated, fuel in the vapor is adsorbed by cartridge 32. After passing through cartridge 32 air and any remaining fuel passes through cartridge 22 where any remaining fuel is trapped and the cleansed air exits through the open solenoid valve 42. When the vehicle is not operating solenoid valve 42 is in its open state and flow adjusting valve 140 is in its closed state except during the first mode of operation described hereinabove when solenoid valve is closed to facilitate charging of cartridge 32. Flow adjusting valve 140 is closed because it was closed by controlling microprocessor 12 after cartridges 22 and 32 were purged. Solenoid valve 42 is open because support 56 with resilient legs 58 holds valve plate 48 in a normally open position and there is no magnetic force closing it because coil 46 is not energized by controlling microprocessor 12.

Third mode of operation—providing fuel vapor at startup.

After cartridge 32 is charged during the first mode of operation as described hereinabove vapor source 10 is capable of fueling an automobile engine when there is sufficient vacuum in the intake manifold to draw fuel vapor from fuel vapor source 10.

At initial starting of the engine there is no vacuum in the intake manifold which requires either liquid fuel to be injected or sufficient cranking to develop a vacuum. For starting, controlling microprocessor causes flow adjusting valve 140 to open a predetermined amount in preparation for operation on fuel from fuel vapor source 10. After manifold vacuum develops controlling microprocessor 12 causes the engine to operate on fuel from fuel vapor source 10.

During the third mode of operation (engine fueling) the vacuum in chamber 146 of the engine intake manifold causes air from solenoid valve 42 to pass through cartridges 22 and 32 where it acquires fuel and through passage 142, flow adjusting valve 140 and passage 144 to chamber 146 of the engine intake manifold. Simultaneously, engine throttle 150 is being controlled by the vehicle operator or by controlling microprocessor 12 to admit air to chamber 146 of the engine intake manifold. In chamber 146 fuel vapor from fuel vapor control valve 140 and air from engine throttle 150 mix and the mixture passes through passage 148 to sensor 160.

During the third mode of operation solenoid valve 42 is in its open state as illustrated in FIG. 1 and flow adjusting valve 140 is being controlled by controlling microprocessor 12 to be sufficiently open to provide a desired air-fuel ratio at sensor 160. Solenoid valve 42 is open because valve plate support 56 is holding valve plate 52 in its normally open position and because coil 46 is not being energized by controlling microprocessor 12. Sensor 160 indicates the air-fuel ratio to controlling microprocessor 12 which may increase or decrease the degree of opening of flow adjusting valve 140 to maintain a desired air-fuel ratio. As operation in the third mode continues the fuel stored in canisters 22 and 32 is depleted. The first species to be depleted is the lightest which is normally a mixture of butanes. As the lightest species are exhausted the canisters 22 and 32 begin supplying heavier components. Depending on its design, sensor 160 may or may not accurately indicate the air-fuel ratio when the mixture contains heavier species. In particular, the preferred design of sensor 160 described herein with reference to FIGS. 3 through 6 must be recalibrated by comparison with the output of another sensor such as the exhaust oxygen sensor to accurately indicate the air-fuel ratio when substantial amounts of heavier species are present.

If sensor 160 no longer indicates the ratio of air to fuel because heavier fractions are being issued by fuel vapor source 10 controlling microprocessor 12 refers to the exhaust oxygen sensor (not illustrated) to ascertain if the engine is receiving the desired air-fuel ratio and adjusts the calibration of sensor 160 to be in agreement with the indication received from the exhaust oxygen sensor. Thus, during the first part of startup, when the exhaust oxygen sensor is not warm enough to operate, sensor 160 provides controlling microprocessor 12 the information needed to accurately control the air-fuel ratio. After a period of operation, when the heavier species begin issuing from fuel vapor source 10 controlling microprocessor 12 obtains the information needed to accurately control the air-fuel ratio from the exhaust oxygen sensor (not illustrated) in combination with information from sensor 160. This method of operation requires the capacity of cartridge 32 to be sufficient to fuel the engine until the exhaust oxygen sensor is warm enough to be operational.

As operation in the third mode continues the rate at which fuel can be obtained from fuel vapor source 10 diminishes until it does not meet the needs of the vehicle engine with adjusting valve 140 completely open. At this point in the third mode of operation the controlling microprocessor augments the fuel from fuel vapor source 10 by injecting liquid fuel but in smaller quantities than when fuel vapor source 10 is not supplying fuel. Flow adjusting valve 140 is kept open until sensor 160 indicates there is no fuel issuing from vapor source 10. This indicates that both cartridges 22 and 32 have been purged and are ready for different modes of operation. It may be desirable to continue operating in the third mode for an additional period of time such as several minutes to additionally assure that cartridge 32 is fully purged. At this time cartridge 22 is ready to receive vapors during a heat soak and cartridge 32 is ready to be recharged or to receive vapors during vehicle fueling. Therefore, at this time, controlling microprocessor 12 closes flow adjusting valve 140 which causes fuel vapor source 10 to operate in its second mode as described hereinabove to prevent hydrocarbon release during vehicle fueling or day night cycles.

The operation of the fuel vapor source 10 of the invention will now be described with reference to FIGS. 3 through 5.

As stated hereinabove, there are three modes of operation of fuel vapor source 10: 1) Charging cartridge 32 of fuel vapor source 10 when it is discharged; 2) Trapping vapors during fueling or day night cycles; and 3) supplying fuel vapor to fuel the engine during initial startup. Operation in the second mode has been fully described hereinabove with reference to FIGS. 1 and 2 and will not be further described hereinafter.

During operation in both the first and third modes controlling microprocessor 12 (illustrated in FIGS. 1 and 2) energizes air pump 190 causing it to operate. Also, during operation in both the first and third modes air not mixed with fuel is drawn from the vehicle intake manifold through passages 134 and 136 to chamber 212 of sensor 210. From chamber 212 it exits through passages 138 and (after mixing with the air and fuel from chamber 214) 168 to air pump 190, passage 204, chamber 194 of spool valve 172 and either through passages 206 and 209 to the outside atmosphere or through passage 205 to the vehicle intake manifold. It is necessary to exhaust to the outside atmosphere during the first mode of operation to prevent fuel vapor from entering the engine intake manifold and reaching passage 134 which would cause the air entering chamber 212 to be impure. It is necessary to exhaust to the engine intake manifold during the third mode of operation to match the manifold vacuum at passage 134 so air pump 190 does not need to achieve the pressure differential between atmospheric pressure and the intake manifold vacuum.

Also, during operation in both the first and third modes air mixed with fuel is drawn through passages 166 into chamber 214 of sensor 210. Accordingly, during operation of sensor 210 chamber 214 contains air and fuel while chamber 212 contains pure air for comparison. When sensor 210 operates to detect fuel vapor or measure the air-fuel ratio it compares the timing of a signal provided by transducer 224 in chamber 214 which contains air and fuel with the timing of a reference signal provided by transducer 222 in chamber 212 which contains pure air.

During the first and third modes of operation ultrasonic transducer 222 repeatedly (at a rate of 1000 times per second or other suitable rate) generates sound pulses which radiate toward cylindrical wall 216. Each sound pulse strikes cylindrical wall 216 and is reflected back to ultrasonic transducer 222 which responds by producing an electric signal. Similarly, ultrasonic transducer 224 repeatedly generates sound pulses which radiate toward cylindrical wall 218. Each sound pulse strikes cylindrical wall 218 and is reflected back to ultrasonic transducer 224 which responds by producing an electric signal.

First mode of operation—charging cartridge 32.

Referring now to FIGS. 1 through 3, during the first mode of operation cartridge 32 is charged with fuel from a mixture of air and fuel drawn from the vehicle fuel tank. To initiate the first mode of operation controlling microprocessor 12 (illustrated in FIGS. 1 and 2) energizes normally open solenoid valve 42 to close (i.e. moving valve plate 52 to the position illustrated in FIG. 2) and air pump 190 to operate. This is done only when the vehicle engine is stopped and there is no vacuum in the engine intake manifold so that spool 174 of spool valve 172 is in the position illustrated in FIG. 3. Accordingly, air pump 190 draws vapor from the vehicle fuel tank into fuel vapor source 10 and through cartridge 32 where fuel is adsorbed as described hereinabove with reference to FIGS. 1 and 2.

Continuing now with reference to FIGS. 3, 4 and 6, after passing through cartridge 32 air and any remaining fuel passes through passage 112, chamber 192 of spool valve 172 and passages 166 of sensor 210 into chamber 214 of fuel vapor sensor 130. Therefore, initially, chamber 214 is receiving pure air through passages 166 because the fuel has been trapped by cartridge 32. Simultaneously, chamber 212 is receiving pure air through passages 134 and 136. Each time the signal from signal generator 320 changes from logic high to logic low ultrasonic transducers 222 and 224 each generate a sound wave. The sound wave generated by ultrasonic transducer 222 radiates outward until it reaches cylindrical wall 216 where it is reflected back to ultrasonic transducer 222. Similarly, the sound wave generated by ultrasonic transducer 224 radiates outward until it reaches cylindrical wall 218 where it is reflected back to ultrasonic transducer 224. While both chambers 212 and 214 contain pure air the speed of sound is approximately the same in both chambers and ultrasonic transducer 222 receives the echo of the sound it generated at about the same time as ultrasonic transducer 224 receives the echo of the sound it generated. The speed of sound may not be precisely the same in both chambers 212 and 214 because the air entering chamber 212 may not have exactly the same temperature and humidity as the air entering chamber 214. Consequently, D-type flip-flop 366 is set at about the same time as D-type flip-flop 376 and the output of exclusive OR 380 is almost always in its low state. Therefore the time period during which clock 390 can advance is zero or very small and the output of clock 390 remains at or very close to zero thereby indicating to controlling microprocessor 12 (illustrated in FIGS. 1 and 2) that there is no fuel mixed with the air in chamber 214 of sensor 210.

As operation in the first mode continues cartridge 32 accumulates more and more fuel. When its capacity is reached the lightest elements of fuel exit through passage 112, chamber 192 of spool valve 172 and passages 166 into chamber 214 of sensor 210. The fuel in the air in chamber 214 causes the speed of sound to be less than the speed of sound in pure air. Chamber 212 continues to be filled with pure air because there is no source of fuel in the engine intake manifold which is the source of the air flowing to chamber 212 of sensor 210 as described hereinabove. Consequently, ultrasonic transducer 224 now receives the echo of the sound it generated later than ultrasonic transducer 222 receives the echo of the sound it generated. Between the time ultrasonic transducer 222 receives the echo of the sound it generated and the time ultrasonic transducer 224 receives the echo of the sound it generated the output of exclusive OR 380 is in its high state which enables clock 390 to increase its output. The increased output is communicated by way of connection 392 to controlling microprocessor 12 (illustrated in FIGS. 1 and 2). When the output of clock 390 reaches a predetermined level, which indicates cartridge 32 is fully charged with fuel, controlling microprocessor 12 deenergizes air pump 190 and normally open solenoid valve 42 which allows solenoid valve 42 to return to its normally open state. This terminates operation in the first mode and leaves cartridge 32 fully charged with high volatility fuel adsorbed on the activated carbon of cartridge 32.

Third mode of operation—supplying fuel vapor to the vehicle engine

Operation in the third mode will now be described with reference to FIGS. 4 through 6. The third mode of operation requires sufficient vacuum at chamber 146 to draw fuel vapor from vapor source 10 and to move spool 174 of spool valve 172 to the position illustrated in FIG. 5. Accordingly, when starting the engine either liquid fuel will be injected or it will be cranked until there is sufficient manifold vacuum for operation on fuel vapor from vapor source 10. To initiate the third mode of operation controlling microprocessor 12 (illustrated in FIGS. 1 and 2) opens flow adjusting valve 140 a predetermined amount known to provide approximately the desired air-fuel ratio. Manifold vacuum then draws fuel vapor from vapor source 10 as described hereinabove with reference to FIGS. 1 and 2 through passage 142, flow adjusting valve 140 and passage 144 into chamber 146 of the engine intake manifold where it mixes with intake air from throttle 150.

The manifold vacuum also causes a pressure differential across piston 182 of spool valve 172 that moves spool 174 of spool valve 172 to the position shown in FIG. 5. Chamber 196 adjacent one side of piston 182 is always at atmospheric pressure because passages 208 and 209 connect it with the atmosphere. Passage 134 connects the other side of piston 102 to the vacuum in the engine intake manifold. The greater pressure in chamber 196 moves piston 182 to the position of FIG. 5. Spring 178 is so designed that the pressure differential between chamber 196 and the manifold vacuum causes spool 174 to be in the position illustrated in FIG. 5 during engine operation except at or near full throttle operation.

Continuing with reference to FIGS. 4 through 6, during the third mode of operation fuel stored in cartridges 22 and 32 of vapor source 10 is with-drawn and mixed with air to obtain an air-fuel ratio approximating the stoichiometric ratio which is believed to be optimum for initial operation. Initially, vapor source 10 releases the lightest species stored which is primarily a mixture of n-butane and iso-butane. The butane is mixed with engine intake air from throttle 150 at chamber 146 of the engine intake manifold to obtain a stoichiometric air-fuel mixture which is routed by the engine intake manifold to the cylinders where it is burned.

During operation in the third mode air pump 190 causes fuel free air to enter chamber 212 through passages 134 and 136 and leave through passages 138 and 168, air pump 190, passage 204, chamber 194 of spool valve 172 and passage 207 to the intake manifold. Simultaneously, air pump 190 causes air-fuel mixture from chamber 148 of the intake manifold to enter chamber 214 through passage 205, chamber 192 of spool valve 172 and passages 166 of sensor 210 and leave through passages 168, air pump 190, passage 204, chamber 194 of spool valve 172 and passage 207 to the intake manifold. Each time the signal from signal generator 320 changes from logic high to logic low ultrasonic transducers 222 and 224 each generate a sound wave. The sound wave generated by ultrasonic transducer 222 radiates outward until it reaches cylindrical wall 216 where it is reflected back to ultrasonic transducer 222. Similarly, the sound wave generated by ultrasonic transducer 224 radiates outward until it reaches cylindrical wall 218 where it is reflected back to ultrasonic transducer 224.

Because chamber 212 contains pure air and chamber 214 contains a mixture of air and fuel in approximately a stoichiometric ratio the speed of sound in chamber 214 is less than the speed of sound in chamber 212 and ultrasonic transducer 224 receives the echo of the sound it generated after ultrasonic transducer 222 receives the echo of the sound it generated. The difference in arrival time of the echoes is proportional to the fraction of fuel in chamber 214. Consequently, during each cycle of signal generator 320, the output of exclusive OR 380 is in its high state for an amount of time proportional to the fraction of fuel in chamber 214. While the output of exclusive OR 380 is in its high state the output of clock 390 advances so that the output of clock 390 is proportional to the fraction of fuel in chamber 214 thereby indicating the reciprocal of the air-fuel ratio to controlling microprocessor 12 (illustrated in FIGS. 1 and 2).

Upon receiving an indication from clock 390, if the air-fuel ratio is within predetermined limits controlling microprocessor 12 takes no action and waits for the results of the next cycle of signal generator 320. If the air-fuel ratio is above the desired range then controlling microprocessor 12 controls flow adjusting valve 140 to open slightly. If flow adjusting valve 140 is operated by a stepping motor this is accomplished by commanding the stepping motor to take one step in the opening direction. If the air-fuel ratio is below the desired range then controlling microprocessor 12 controls flow adjusting valve 140 to close slightly. If flow adjusting valve 140 is operated by a stepping motor this is accomplished by commanding the stepping motor to take one step in the closing direction.

As fuel vapor source 10 continues to supply fuel to the engine the most volatile species (mostly butanes) become exhausted and the next most volatile species (mostly pentanes) issue. When this happens the relationship between the air-fuel ratio and the signal output from clock 390 changes. In the case of changing from pure butanes to pure pentanes the indication from sensor 210 based on the velocity of sound is that the mixture is richer than it actually is. Therefore, cartridge 32 should be large enough that the exhaust oxygen sensor (not illustrated) has sufficient time to warm up and begin operating before the less volatile species from vapor source 10 predominate. With the exhaust oxygen sensor operating the controlling microprocessor adjusts flow adjusting valve 140 in accordance with both sensor 210 and the exhaust oxygen sensor. The sensor 210 provides an immediate indication of the air-fuel ratio upon which adjustment of flow adjusting valve 140 is based and the exhaust oxygen sensor provides a slightly delayed indication of the air-fuel ratio which is used for adjusting and recalibrating the output of sensor 210.

As vapor source 10 becomes depleted the output of fuel diminishes so that even with flow adjusting valve 140 completely open injection of liquid fuel is required. As vapor source 10 becomes further depleted the rate of liquid fuel injection is increased as required until vapor source 10 is purged and flow adjusting valve 140 is closed. Also, operation on liquid fuel is required when the throttle is at or near its wide open position because then there is insufficient vacuum to draw fuel vapor from fuel vapor source 10 or to keep spool 174 of spool valve 172 in the position illustrated in FIG. 5. It is important to completely purge fuel vapor source 10 whenever it is used to supply fuel vapor because a partially discharged carbon canister retains high proportions of heavier species which, if not removed by purging, would reduce the capacity of the canister to store the lighter species. Therefore operation in the third mode continues under control of the controlling microprocessor (illustrated in FIGS. 1 and 2) until the output of clock 390 approaches to within a predetermined difference from zero indicating the air passing through chamber 214 does not contain fuel. Further, it may be desirable to continue purging vapor source 10 for a predetermined time after no fuel is being sensed by sensor 210 to further assure complete purging of cartridge 32.

The invention may also be operated to provide fuel vapor directly from the vehicle fuel tank. Operation on vapor directly from the fuel tank will now be described with reference to FIGS. 2 and 4 through 6. Operation on vapor directly from the fuel tank is similar to the third mode of operation described hereinabove except in the following particulars. To initiate operation on vapor directly from the fuel tank controlling microprocessor 12 (illustrated in FIGS. 1 and 2) closes solenoid valve 42 as illustrated in FIG. 2. With solenoid valve 42 closed manifold vacuum draws vapor from the fuel tank through tube 108 to nipple 106 of vapor source 10, through cavity 18, passage 142, flow adjusting valve 140, passage 144 to chamber 146 where it mixes with air from throttle 150. The vapor received from the fuel tank under most circumstances will be butane with a substantial fraction of pentane and some heavier fractions. Accordingly, controlling microprocessor 12 may assume such a fraction which will be satisfactory for most operation if the exhaust oxygen sensor is not operating. When the exhaust oxygen sensor is warm enough to operate it provides information for calibrating air-fuel ratio sensor 160. Further, controlling microprocessor may remember the calibration from a previous time when the oxygen sensor was operating and use that calibration as a best estimate of the calibration before the oxygen sensor becomes operational. When operation on fuel vapor directly from the vehicle fuel tank is complete controlling microprocessor 12 opens solenoid valve 42. In all other aspects the operation is the same as operation in the third mode described fully hereinabove to which description the reader is referred.

Although the description of this invention has been given with reference to a particular embodiment, it is not to be construed in a limiting sense. Many variations and modifications will now occur to those skilled in the relevant arts. For a definition of the invention reference is made to the appended claims.

What is claimed is:

1. A fuel vapor source (10) for supplying fuel vapor to a vehicle engine comprising a container containing a first fuel vapor adsorbing material (32) and also comprising:

fuel tank connection means (108) for connecting said fuel vapor source with a fuel tank of a vehicle, fuel charging means comprising vapor drawing means (112, 192, 166, 168, 190, 204, 194,206, 209) adapted to draw air and fuel vapor from said fuel tank through said fuel tank connection means and through said first fuel vapor adsorbing material, fuel supplying means comprising said first fuel vapor adsorbing material and combining means (142, 144, 146, 148, 150) for combining stored fuel from said first fuel vapor adsorbing material and combustion air and supplying said combination to said engine, first sensing means (160) adapted to indicate the fraction of fuel in said combined fuel and combustion air, and first valve means (12, 140) responsive to said first sensing means by controlling said fraction of fuel.

2. The invention as defined by claim 1 wherein said container also contains a second fuel vapor adsorbing material (22) whereby, said fuel vapor source also operates to adsorb fuel from vapor released from said vehicle fuel tank to relieve pressure.

3. The invention as defined by claim 1 wherein said first sensing means comprises a first chamber (214) and including:

first passage means (166, 205) adapted to provide said combined fuel and combustion air to said first chamber during said combining of stored fuel and combustion air, first timing means (218, 224, 250) adapted to cause sound to traverse a first predetermined route in said first chamber, and wherein:

said first sensing means is responsive to the time for sound to traverse said first predetermined route.

4. The invention as defined by claim 3 wherein:

said first predetermined route comprises a first outward route and a first return route that is the reverse of said first outward route, whereby the effect of movement of said combined fuel and combustion air in said first chamber is minimized.

5. The invention as defined by claim 4 wherein:

said first outward route is a radial traversal from a cylindrical starting position and said first return route is a radial traversal returning to said starting position, whereby said returning sound is focused onto said starting position.

6. The invention as defined by claim 3 wherein said first sensing means comprises a second chamber (212) and including:

second passage means (134, 136) adapted to provide air to said second chamber during said combining of stored fuel and combustion air, second timing means (216, 222, 250) adapted to cause sound to traverse a second predetermined route in said second chamber, and wherein:

said first sensing means is responsive to the difference between said time for sound to traverse said first predetermined route and the time for sound to traverse said second predetermined route.

7. The invention as defined by claim 1 including:

second sensing means (130) adapted to indicate when said first fuel vapor adsorbing material is charged with fuel, and control means (12) responsive to said second sensing means by terminating said drawing of air and fuel vapor from said fuel tank by said vapor drawing means.

8. The invention as defined by claim 7 wherein said second sensing means comprises a third chamber (214) and including:

third passage means (112, 166) for providing said air and fuel vapor drawn by said vapor drawing means that has passed through said first fuel vapor adsorbing material to said third chamber during said drawing of air and fuel vapor, third timing means (218, 224, 250) adapted to cause sound to traverse a third predetermined route in said third chamber, and wherein:

said second sensing means is responsive to the time for said sound to traverse said third predetermined route.

9. The invention as defined by claim 8 wherein:

said third predetermined route comprises a third outward route and a third return route that is the reverse of said third outward route, whereby the effect of movement of said air and fuel vapor in said third chamber is minimized.

10. The invention as defined by claim 9 wherein:

said third outward route is a radial traversal from a third cylindrical starting position and said third return route is a radial traversal returning to said third starting position, whereby said returning sound is focused onto said third starting position.

11. The invention as defined by claim 8 wherein said second sensing means comprises a fourth chamber (212) and including:

fourth passage means (134, 136) adapted to provide air to said fourth chamber during said drawing of air and fuel vapor, fourth timing means (216, 222, 250) adapted to cause sound to traverse a fourth predetermined route in said fourth chamber, and wherein:

said second sensing means is responsive to the difference between said time for sound to traverse said third predetermined route and the time for sound to traverse said fourth predetermined route.

12. The invention as defined by claim 1 wherein:

said vapor drawing means comprises an air pump (190).

13. The invention as defined by claim 1 wherein:

said fuel charging means comprises valve means (42) adapted to insure said vapor drawing means draws vapor only from said fuel tank.

14. The invention as defined by claim 3 and including:

second sensing means (130) comprising a third chamber (214) and third timing means (218, 224, 250) adapted to indicate when said first fuel vapor adsorbing material is charged with fuel, third passage means (112, 166) adapted to provide said air and fuel vapor drawn by said vapor drawing means that has passed through said first fuel vapor adsorbing material to said third chamber during said drawing of air and fuel vapor, third timing means (218, 224, 250) adapted to cause sound to traverse a third predetermined route in said third chamber, and wherein:

said second sensing means is responsive to the time for sound to traverse said third predetermined route and including:

control means (12) responsive to said second sensing means by terminating said drawing of air and fuel vapor from said fuel tank by said vapor drawing means.

15. The invention as defined by claim 14 and including:

valve means (172) adapted to connect said first chamber with said third passage means during said drawing of air and fuel vapor, whereby said third chamber is the same chamber as said first chamber.

16. The invention as defined by claim 14 wherein said first sensing means comprises a second chamber (212) and including:

second passage means (134, 136) adapted to provide air to said second chamber during said combining of stored fuel and combustion air, second timing means (216, 222, 250) adapted to cause sound to traverse a second predetermined route in said second chamber, and wherein:

said first sensing means is responsive to the difference between said time for sound to traverse said first predetermined route and the time for sound to traverse said second predetermined route.

17. The invention as defined by claim 16 wherein said second sensing means comprises a fourth chamber (212) and including:

fourth passage means (134, 136) adapted to provide air to said fourth chamber during said drawing of air and fuel vapor, fourth timing means (216, 222, 250) adapted to cause sound to traverse a fourth predetermined route in said fourth chamber, and wherein:

said second sensing means is responsive to the difference between said time for sound to traverse said third predetermined route and the time for sound to traverse said fourth predetermined route.

18. The invention as defined by claim 17 wherein:

said fourth chamber is the same chamber as said second chamber.

19. A fuel vapor source (10) for supplying fuel to a vehicle engine comprising a container containing a first fuel vapor absorbing material (32) having absorbed fuel and also comprising:

fuel supplying means comprising combining means (142, 144,146,148,150) adapted for combining said absorbed fuel and combustion air and supplying said combination to said engine, first sensing means (160, 12) adapted to indicate the fraction of fuel in said combined fuel and combustion air, first valve means (12, 140) responsive to said sensing means by controlling said fraction of fuel, fuel tank connection means (108) for connecting said fuel vapor source with a fuel tank of a vehicle, and fuel charging means comprising vapor drawing means (112,192,166,168,190,204,194,206,209) adapted to draw air and fuel vapor from said fuel tank through said fuel tank connection means and through said first fuel vapor absorbing material.

20. A sensor responsive to the fraction of fuel vapor in a mixture of air and fuel vapor comprising:

first sound generating means (224, 250) adapted for generating sound in said mixture of air and fuel vapor, first sound reflecting means (218) adapted for reflecting said sound generated by said first sound generating means, said first sound generating means being responsive to receipt of said reflection of said sound generated by said first sound generating means, and signal processing means (250) adapted to provide an output signal responsive to the elapsed time between said sound generation by said first sound generation means and said sound receipt.

21. The invention as defined by claim 20 wherein:

said first sound generating means comprises a piezoelectric transducer.

22. The invention as defined by claim 20 wherein:

said first sound generating means comprises a transducer having a first cylindrical surface and adapted to generate sound waves travelling radially from said first cylindrical surface, and said first sound reflecting means comprising a second cylindrical surface positioned concentrically with said first cylindrical surface, whereby said sound generated by said first sound generating means travels radially to said first sound reflection means and its reflection returns radially to said first sound generating means for receipt thereby.

23. The invention as defined by claim 20 and including:

second sound generating means (222, 250), adapted for generating sound in air not mixed with fuel vapor, second sound reflecting means (216) adapted for reflecting said sound generated by said second sound generating means, said second sound generating means being responsive to receipt of said reflection of said sound generated by said second sound generating means, and wherein:

said signal processing means being adapted to provide an output signal responsive to the elapsed time between said receipt of said reflection of said sound generated by said second sound generating means and said receipt of said reflection of said sound generated by said first sound generating means.

24. A fuel vapor source (10) for supplying fuel vapor to a vehicle engine comprising fuel tank connection means (108) for connecting said fuel vapor source with a fuel tank of a vehicle and also comprising:

vapor drawing means (106, 18, 142) adapted to draw vapor from said fuel tank through said fuel tank connection means, fuel supplying means comprising said vapor drawing means and combining means (144, 146, 148, 150) for combining said vapor supplied by said vapor drawing means and combustion air and supplying said combination to said engine, first sensing means (160) adapted to indicate the fraction of fuel in said combined fuel and combustion air, and first valve means (12, 140) responsive to said first sensing means by controlling said fraction of fuel.

* * * * *